United States Patent [19]

Mucha et al.

[11] Patent Number: 4,728,761

[45] Date of Patent: Mar. 1, 1988

[54] METHOD AND APPARATUS FOR HARDENING AXIALLY SPACED CAMS ON A CAMSHAFT

[75] Inventors: George M. Mucha, Parma Hts.; John R. Laughlin, Broadview Hts., both of Ohio; William Z. Nelson, Attalla; Robert C. Johnson, Albertville, both of Ala.

[73] Assignee: Tocco, Inc., Boaz, Ala.

[21] Appl. No.: 859,348

[22] Filed: May 5, 1986

Related U.S. Application Data

[63] Continuation-in-part of Ser. No. 736,214, May 20, 1985, Pat. No. 4,604,510.

[51] Int. Cl.[4] ..... H05B 6/40; H05B 6/14

[52] U.S. Cl. ..... 219/10.43; 219/10.57; 219/10.49 R; 219/10.67; 148/147; 148/150; 266/127; 266/129

[58] Field of Search ..... 219/10.57, 10.43, 10.41, 219/10.49 R, 10.67, 10.69, 10.71, 10.77, 10.79; 148/150, 146, 147, 152, 154; 266/129, 130, 124, 134, 127, 114

[56] References Cited

U.S. PATENT DOCUMENTS

| | | | |
|---|---|---|---|
| 2,295,777 | 9/1942 | Denneen | 219/10.79 X |
| 3,622,138 | 11/1971 | Kostyal | 266/129 X |
| 3,784,780 | 1/1974 | Laughlin et al. | 219/10.43 |
| 3,944,446 | 3/1976 | Bober | 148/150 X |
| 4,059,795 | 11/1977 | Mordwinkin | 324/233 |
| 4,230,987 | 10/1980 | Mordwinkin | 324/236 |
| 4,604,510 | 8/1986 | Laughlin et al. | 219/10.43 |

OTHER PUBLICATIONS

Lengyel, "Post Grind Hardening", SAE Technical Paper, Series No. 860231, Feb. 1986.

*Primary Examiner*—Philip H. Leung

*Attorney, Agent, or Firm*—Body, Vickers & Daniels

[57] ABSTRACT

Method and apparatus for inductively heating and quench hardening axially spaced cams on a steel camshaft having a longitudinally extending rotational axis concentric with a plurality of axially spaced bearings, which method and apparatus utilizes an induction heating coil having an inner surface surrounding the rotational axis of the camshaft with an insulating gap and integral quench openings for directing quenching liquid inwardly from the heating coil for the workpiece, and a high frequency power supply for selectively energizing the heating coil with a power density within the heating coil of about 20KW/in$^2$ and an auxiliary cooling assembly fixed with respect to the heating coil and including an arrangement for spraying a cooling liquid toward the camshaft. In accordance with the method and apparatus, a camshaft is indexed axially through the opening of the coil and cooling assembly to a first position with a cam within the coil, at which position the camshaft is indexed to have the lobe of the cam facing the gap in the induction heating coil and a hardening cycle is then employed including induction heating of the surface of the camshaft while the cam is stationary and then quench hardening by directing a quenching fluid through the induction heating coil toward the previously heated cam surface. After this heating cycle, the camshaft is then moved until the next cam is within the heating coil and the previously hardened cam is in the cooling assembly. Thereafter, another hardening cycle occurs. This process is repeated until all cams have been hardened.

54 Claims, 25 Drawing Figures

FIG. 2
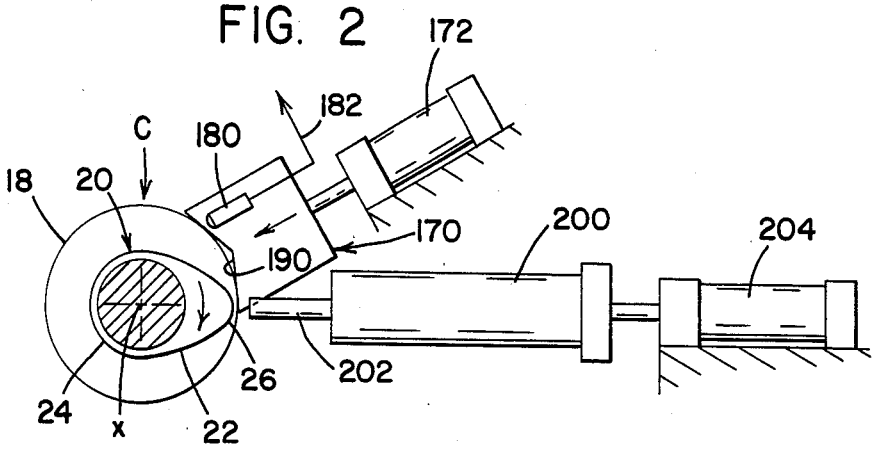
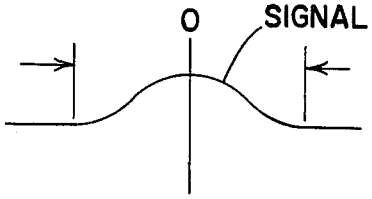
FIG. 3
FIG. 4
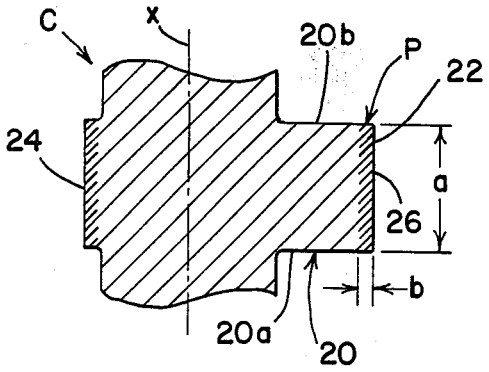

FIG. 6A
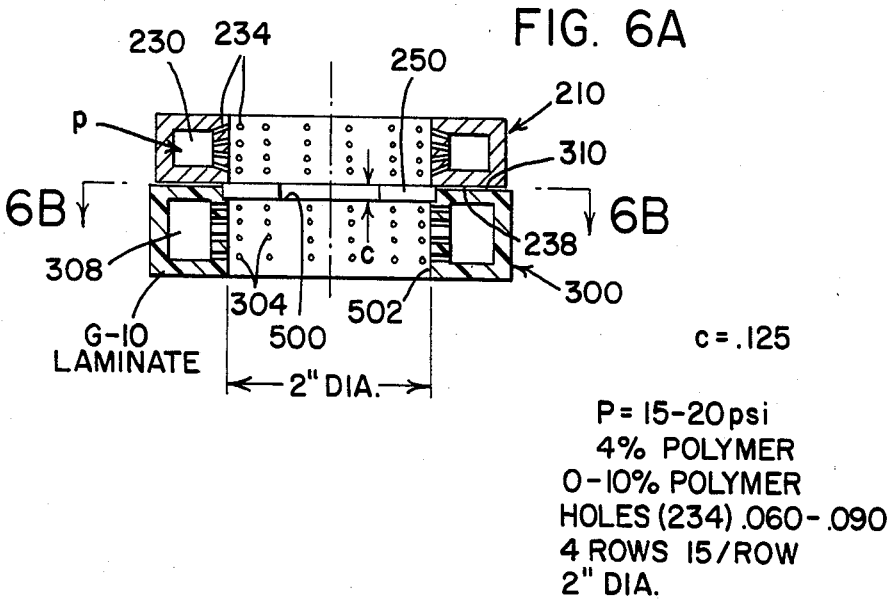
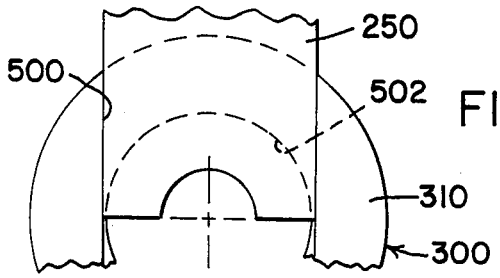
FIG. 6B
FIG. 6C
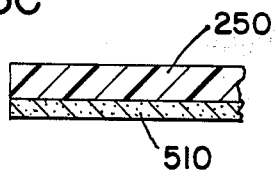

METHOD AND APPARATUS FOR HARDENING AXIALLY SPACED CAMS ON A CAMSHAFT

This application is a continuation-in-part application of prior application Ser. No. 736,214, filed May 20, 1985, now U.S. Pat. No. 4,604,510. This prior application is incorporated by reference herein.

INCORPORATION BY REFERENCE

In addition to the prior and co-pending applications by the same assignee, as identified above, U.S. Pat. Nos. 3,944,446 Bober 3,784,780 Laughlin and Mucha, are incorporated herein as background information regarding prior machines for inductively heating the cams spaced axially along a camshaft of the type used for internal combustion engines. Kostyal U.S. Pat. No. 3,622,138 is incorporated by reference herein as background information regarding an induction heating device having a non-mechanical, programmable control arrangement for selectively heating selected axially spaced portions on elongated, rotatably mounted workpiece.

U.S. Pat. Nos. 4,059,795 Mordwinkin and 4,230,987 Mordwinkin are incorporated by reference herein as they relate to digital eddy current apparatus for detecting the condition of hardened surfaces for the purposes of testing of the type employed by the present invention. Of course, other mechanisms could be employed for the testing scan, as disclosed and employed in the preferred embodiment of the present invention.

An SAE article entitled "Post Grind Hardening, an Alternative Method of Manufacturing a Steel Roller Camshaft" delivered at the International Congress and Exposition on Feb. 24–28, 1986 and published as an SAE technical paper series No. 860231, is also incorporated by reference herein to explain the background of the present invention and the advantages obtained by employing the present invention as developed by assignee and used in a preferred embodiment of the present invention.

Application Ser. No. 769,399, filed Aug. 26, 1985, now U.S. Pat. No. 4,618,125 is incorporated by reference herein.

BACKGROUND OF THE INVENTION

The present invention relates to the art of induction heating and, more particularly, a method and apparatus for hardening axially spaced cams on a camshaft of the type used in internal combustion engines.

The invention is particularly applicable for inductively heating the axially spaced cams on an automobile engine camshaft formed from forged steel and it will be described with particular reference thereto; however, the invention has much broader applications and may be used for inductively heating the axially spaced cams on a variety of camshafts formed from various types of ferrous material.

Within the last few years, there has been a substantial demand for highly efficient, high performance internal combustion engines to be used in vehicles wherein the engine must have a reduced, combined rotational friction and be capable of operating at relatively high rotational velocities. Further, these engines must be reduced in weight and relatively simplified to thereby decrease the overall weight-to-horsepower ratio of the engine, so that fuel economy can be optimized. All of these commercial factors, together with foreign competitive situations, has resulted in a substantial amount of effort devoted to designing and manufacturing each component in the engine. One of the more critical components in an internal combustion engine is the rotating camshaft, which shaft has a plurality of axially spaced cams, each with a lobe that actuates a valve during operation of the engine. To decrease friction and increase rotational speed, it has been decided by many engine manufacturers to employ a roller follower adapted to contact the outer eliptical or eccentric surface of each cam to transmit the cam action to the valve itself. These roller followers exert a substantial force against the cam surface as the camshaft is rotated. In addition, due to the speed of operation, the cam surfaces must be very accurately controlled in dimensional characteristics to provide the efficient operation of the valve during engine operation. To accommodate the wear and provide dimensional accuracy, it has, in the past, been somewhat common practice to manufacture the camshaft from cast iron. The cams of the cast iron camshaft were then machined and hardened by first inductively heating the cam surface by surrounding inductor and then quench hardening the heated surface. To increase production, which is always an essential element of this type of equipment, devices such as those shown in U.S. Pat. Nos. 3,944,446 Bober and 3,784,780, Laughlin were developed by assignee of this application. Also, carbonized hardening processes were employed. Further, induction heating of all cams at the same time with plunge quenching was used for the purpose of heating the various camshafts. In these instances, the camshaft was rotated to provide uniformity. In addition, relatively low power densities were employed, below about 10 $KW/in^2$, so that the hardened depth of the various cams was somewhat deep. All these processes required subsequent grinding and stoning for the purposes of generating the final cam surfaces, which must be done accurately. In other words, the hardened surfaces had to have a sufficient depth to facilitate actual generation of the cam surfaces subsequently by grinding and/or stoning. These post hardening processes necessitated relatively deep hardness and resulted in tools which needed dressing or changing after short periods of operation. All of these problems drastically increase the cost of the camshaft and often resulted in a cast iron hardened surface which was not sufficiently rigid to support high speed roller operations. This general situation required a re-thinking of camshaft technology for internal combustion engines of the type used in modern motor vehicles.

One of the solutions to the problems was to produce a forged steel camshaft blank which could be machined, inductively heated on the bearing surfaces of the cams, and then quench hardened, following by at least a stoning operation. The theory was, among other things, that the steel camshaft would have sufficient surface stability after hardening to operate in modern day motor vehicles. In addition, the steel camshafts could apparently be somewhat reduced in weight. All of these attributes contributed to the selection of this type of camshaft for use in the more recently manufactured engines for motor vehicles, at least for the United States market. Many people used the prior induction heating devices for the purpose of hardening the cams and also the fuel pump eccentric and distributor gear on the camshafts. Generally, the bearing surfaces concentric with the rotational axis of the camshaft could be left fairly soft since they presented a substantial area for support by axially spaced bearing blocks. Assignee of applicants, through applicants, embarked upon a revolutionary new approach for the purposes of hardening the surface of cams axially spaced along the camshaft, which process would overcome all of the disadvantages resulting from the mere attempt to use prior induction heating technology for these revolutionary new and technically complicated hardening problems. Applications of known technology did not produce camshafts at a production rate or quality meeting the present day demand. The present invention utilizes an approach described generally in the SAE technical paper series, No. 860231, entitled "Post Grind Hardening, an Alternative Method of Manufacturing a Steel Roller Camshaft".

THE INVENTION

The present invention relates to a machine culminating in the development of a process and apparatus for using induction heating to produce camshafts which have the cams individually induction heated and then quench hardened in a manner producing dimensional stability, substantially uniform hardening and at a rapid rate concomitant with production requirements by the automobile industry.

The primary object of the present invention is the provision of a method and apparatus for hardening the surfaces of axially spaced cams on a camshaft, which method and apparatus produce uniformly hardened, dimensionally stable surfaces at a high production rapid rate and with a low amount of scrap.

Another object of the present invention is the provision of a method and apparatus, as defined above, which method and apparatus utilizes a single induction heating coil having its own power supply for energizing the coil as the coil surrounds the cam surface.

Yet another obJect of the present invention is the provision of a method and apparatus, as defined above, which method and apparatus inductively heats a single cam surface at a rate of between 0.3 to 3.0 seconds and, preferably, in the neighborhood of about 1.0 second without diminution of uniformity and without sacrificing quality around the total surface of the cam.

Another object of the present invention is the provision of a method and apparatus, as defined above, which method and apparatus results in cam surfaces which require no post grinding for generating the axial cam surface and diminishes the amount of post stoning needed for finishing the surface of the various cams.

Yet a further object of the present invention is the provision of a method and apparatus, as defined above, which method and apparatus inductively heats each cam surface while it is held in an indexed position by an induction heating coil, which coil has its heating characteristics modified or controlled by flux concentrations so that the indexed position of the cam surface is a fixed position commensurate with the necessary heating pattern and hardness pattern associated with the particular heating coil. In accordance with the preferred embodiment, the nose, tip or lobe of the cam is pointed toward the fishtail or insulation gap in the induction heating coil. In accordance with this aspect of the invention, on high power, exceeding 25 KW/in$^2$ for a short time, in the neighborhood of 1.0 second, can inductively heat the total surface of the cam for immediate quench hardening by low volume polymer quench fluid directed at the heated cam surface through the inductor or heating coil.

Still a further object of the present invention is the provision of a method and apparatus, as defined above, which method and apparatus includes an arrangement for scanning each of the cam surfaces of the camshaft by an eddy current coil and detecting the electrical characteristics of the coil to determine whether or not the various cam surfaces have a hardness characteristic coming within a preselected acceptable range of responses at each of the various cams. In accordance with this object, the eddy current testing of the various cams can occur subsequent to sequential hardening of the various cams and as the cams pass through the eddy current coil. This non-destructive non-touching arrangement for determining hardness on-the-fly, when incorporated with the sequential hardening of the cam surfaces, produces a uniform hardening process, as described in prior application Ser. No. 769,399 filed Aug. 26, 1985.

Another object of the present invention is the provision of a method and apparatus, as defined above, which method and apparatus employs a unique combination of coil, cooling assembly and operable splash plates forming a lower wall below the cam surface being heated.

Still a further object of the present invention is the provision of the structure, as defined in the appended claims.

In accordance with the present invention, to satisfy the above objects, there is provided a method and apparatus for inductively heating, and then quench hardening, the surfaces of axially spaced cams on a steel camshaft having a longitudinally extending rotational axis concentric with a plurality of axially spaced bearings, each having surfaces concentric to the rotational axis. The cams have lobes with differing circumferential locations. The invention employs means for rotatably mounting the camshaft to rotate about a worked axis coinciding with the rotational axis of the workpiece, an induction heating coil having an inner surface surrounding the work axis with an insulating gap and integral quenching openings for directing, at low volume rate, a liquid inwardly from the heating coil toward the work axis of the workpiece, a high frequency (10 KHz–25 KHz) power supply for inductively energizing the heating coil with a power density within the heating coil of over about 20 KW/in$^2$, an auxiliary cooling assembly fixed with respect to the heating coil at an axially spaced position near the heating coil and including means for spraying a cooling liquid toward the work axis, first drive means for causing relative axial movement of the camshaft and the heating coil to position a cam in the heating coil during a hardening cycle, including an induction heating portion and a quench hardening portion, second drive means for rotating the camshaft about the work axis, means for controlling the second drive means for selectively rotating the camshaft to an indexed position with the cam in the coil having a preselected fixed circumferential orientation during at least the heating portion of the heating cycle, which orientation is preferably with the lobe facing the insulating gap of coil, means for selectively operating the power supply means during the heating portion of the cam hardening cycle, means for selectively operating the cooling assembly during at least the heating portion of the hardening cycle for a cam in the heating coil, control means for repeatedly operating the first drive means, the second drive means, the power supply operating means, the cooling assembly and operating means for axially indexing a further cam into the fix orientation within the heating coil for hardening during a hardening cycle while a previously, axially adjacent, cam is cooled in the cooling assembly. Means are provided for preventing splashing of the cooling liquid into the cam in the heating coil during the heating portion of the heating cycle.

By processing the cam surfaces individually with high power density and a low time, in the range of 0.3 to 3.0 seconds and preferably 1.0 second, the surface is heated rapidly and immediately quench hardened by an integral quenching arrangement. There is little time for growth to distort the surfaces. The high frequency keeps the heating depth quite shallow and near the surface so that any grain growth will be minimized by this shallow depth and the rapid temperature increase and decrease. This processing concept gives the cam surface little time to grow and has little heated mass in which to effect growing. Dimensional stability is maintained so that post grinding is not required. This stability feature is accomplished by using relatively high frequency, about 10 KHz, high power factor and short heating time followed by an immediate liquid quench. This process is done by a single inductor heating a single surface preparatory to quench hardening. The quench hardening cycle requires a volume of liquid, but a very short time; however, high velocity inpingement is avoided by using larger quenching holes so there is no abrupt spot quenching caused by high velocity liquid jets. Heat is to be extracted by the quenching fluid over the total surface, instead of by mass quenching by core material behind the heated surface. Each coil has its own power supply to obtain the high power density. In accordance with the preferred embodiment of the present invention, two separate heating and quench hardening assemblies are provided on parallel axes, each driven by its separate high frequency power supply. In this manner, production rates can be doubled by processing two camshafts simultaneously.

A method and apparatus, as defined above, satisfies the previously mentioned objects and advantages. Other objects and advantages will become apparent from the following description used to illustrate the preferred embodiment of the invention, as read in conjunction with accompanying drawings:

BRIEF DESCRIPTION OF THE DRAWINGS

FIG. 2 is a schematic partial view illustrating the initial shaft locator mechanism and final stamp for an approved accepted camshaft;

FIG. 3 is a graph illustrating, somewhat schematically, the output of a proximity switch on the locator, as illustrated in FIG. 2:

FIG. 4 is an enlarged, cross-sectional view taken diametrically through a portion of the camshaft after hardening and illustrating the hardness pattern at the heel and lobe of one cam surface;

FIG. 6A is a cross-sectional view of the coil and quench unit of the current preferred embodiment;

FIG. 6B is a cross-sectional view taken generally along line 6B—6B of FIG. 6A;

FIG. 6C is a partial cross-sectional view showing a flux shielding element used in the structure of FIGS. 6A and 6B;

PREFERRED EMBODIMENT

Figure 1:
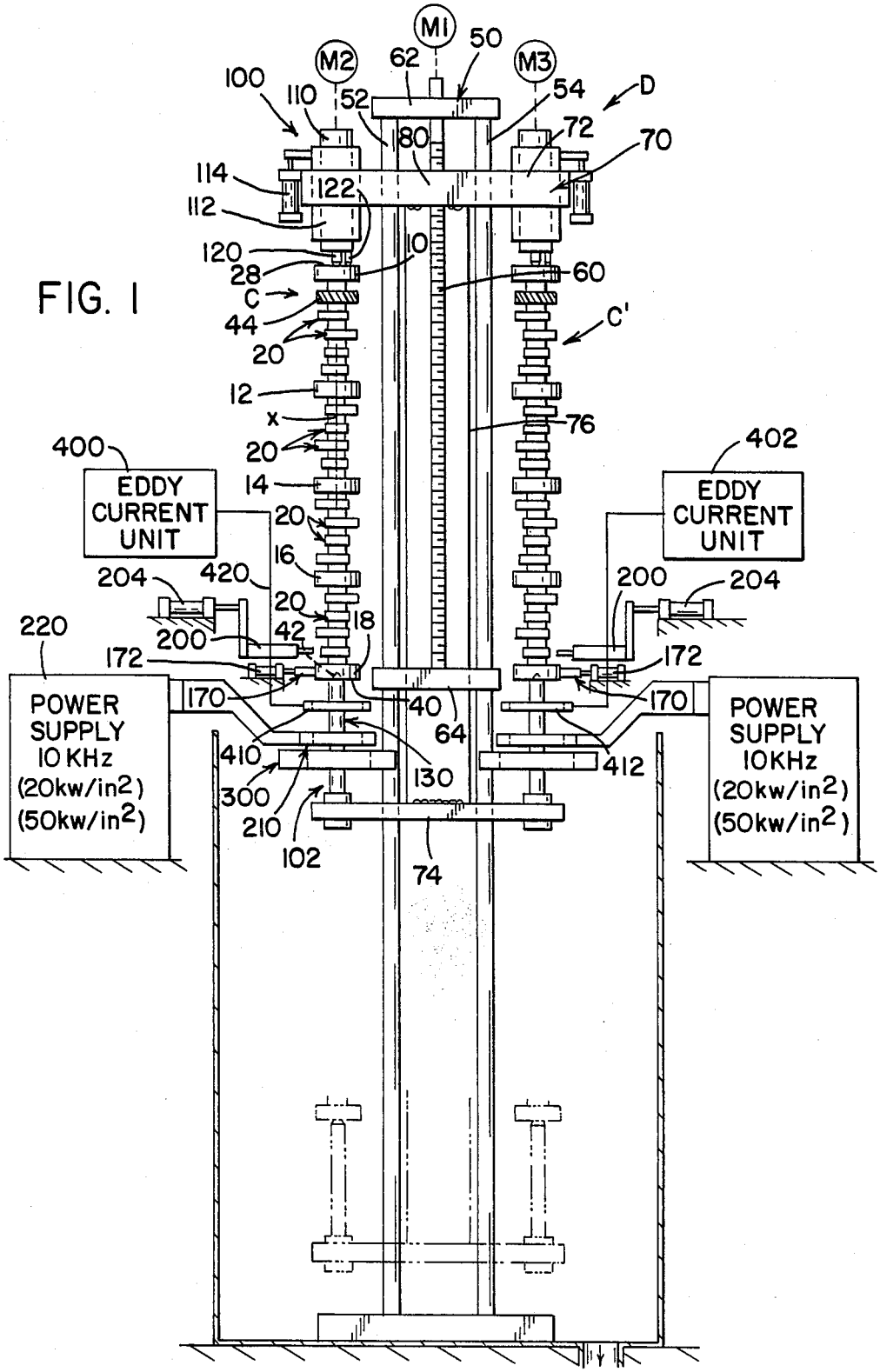
FIG. 1 is a front elevational view showing, somewhat schematically, the preferred embodiment of the present invention for processing two camshafts C, C′ in parallel, vertical disposition.

Referring to the drawings where the showings are for the purpose of illustrating the preferred embodiment of the invention only, and not for the purpose of limiting same, device D shown in FIG. 1 is employed for hardening the cam surfaces on a camshaft C. In the preferred embodiment of the invention, a second camshaft C′ is processed in unison with camshaft C by the same arrangement and mechanism; therefore, only camshaft C will be described in detail and the same description will apply equally to the parallel camshaft C′. Camshaft C is formed of forged steel and includes a longitudinally extending axis x and has axially spaced bearing surfaces 10, 12, 14, 16 and 18. Of course, various types of camshafts, with a variety of cams, can be processed in accordance with the present invention by device D and the particular camshaft herein illustrated is for the purposes of description only and not for any limitation on the inventive concepts. The camshaft employs cams 20 axially spaced along axis x with each cam having a heel 24 and a lobe 26, which lobe extends outwardly in a radial direction greater than the heel 24. The orientation of lobes 26 of the various cams 20 is circumferentially different, to operate cams in accordance with standard technology. These cams each include outer surfaces 22 which are to be inductively heated and then quench hardened to provide a hardness pattern P as shown in FIG. 4. This pattern extends axially across the width A of cam 20 and inwardly a distance B. The short heating and then immediate quenching causes the depth b to be nearly the reference depth caused by the power supply frequency. Low depth and short time results in a short burst of energy. With the energy affecting the distortion in a direct relationship, processing as employed in the invention minimizes such distortion. In accordance with the preferred embodiment of the invention, the depth b is generally uniform around surface 22. This is accomplished by holding the cam stationary within the induction heating coil during the induction heating process and positioning the cam and coil with respect to various flux concentrating devices to produce a uniform hardness pattern P. The heating cycle is accomplished by a high power density heating process providing at least 20 $KW/in^2$ at surface 22 and, preferably, in the neighborhood of 50 $KW/in^2$. This high power density occurs for only a short period of time between 0.3 and 3.0 seconds, and preferably 1.0 second. Consequently, depth b is controlled primarily by the frequency of the power supply used in the heating operation. In practice, this is between 10 KHz and 25 KHz. The greater the frequency, the smaller the distance b. Since the heating cycle is high power and low time and the surface is immediately quenched by high flow liquid, the thickness of the hardness pattern is basically determined by the frequency of the heating operation. As the frequency increases, the thickness decreases; therefore, the frequency is selected between 10 KHz and 25 KHz for the purposes of controlling the desired thickness which is immediately frozen by subsequent liquid quenching. This combines with the normal mass quenching to preclude growth of the metal in the hardness pattern.

Camshaft C includes an upper end surface 28 having a center countersink 30 on axis x and an axially spaced locator bore 32. A bottom locator surface 40 includes a countersink 42 on axis x. In accordance with normal practice, the camshaft also includes a fuel pump gear 44, which is to be hardened. Bearings 10–18 in this illustrated embodiment are not hardened.

Referring now to device D, it includes a fixed frame 50 having vertically extending rods or posts 52, 54. A downwardly extending screw 60 is rotatably mounted in spaced journals 62, 64 by motor M1. This motor can be rotated in both directions and to any selected angular position, usually rotation is contracted by counting pulses from an encoder associated with Motor M. On fixed frame 50 is mounted a movable frame 70 reciprocally received on rods 52,54 by an upper plate 72 and a lower plate 74 secured together as a unit by a vertical standard 76. As so far described, frame 70 reciprocates on rods 52,54 by appropriate journals in plates 72, 74. Plate 72 is secured with respect to feed screw 60 by a nut section or portion 80. Rotation of screw 60 moves frame 70 along rods 52, 54 by the interaction between the nut section 80 and threads on screw 60. As so far described, as motor M1 is rotated, movable frame 70 is reciprocated with respect to fixed frame 50. Motor M1 is a servo-motor movable in both directions and accurately positioned at any angular disposition to determine accurately, in accordance with standard practice, the vertical position of the movable frame 70 on fixed frame 50.

Figure 10:
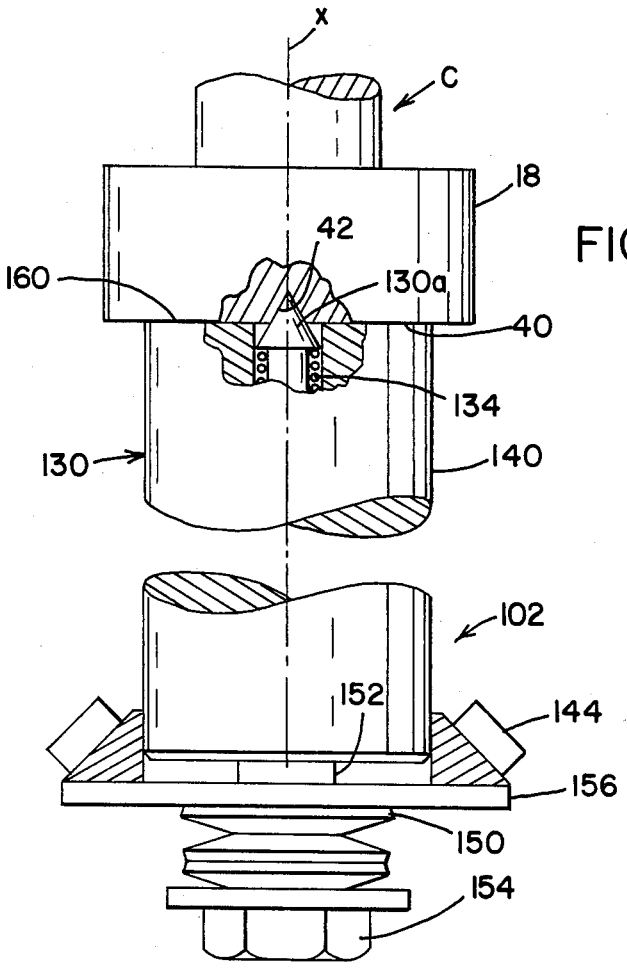
FIG. 10 is an enlarged detailed partial view showing the lower head of the camshaft mounting mechanism.

The mounting arrangement for the camshaft includes an upper head 100 secured to plate 72 and a lower head 102 secured to plate 74. These heads are schematically illustrated in FIG. 1 for the purposes of explaining the operation of device D; however, certain details of the lower head are shown in FIG. 10. Upper head 100 includes a spindle 110 rotated by drive motor M2 having two modes of operation, one mode indexes the spindle in a circumferential direction and the other mode allows continuous rotation of the spindle. This type of drive motor is a standard servo-motor, which is used to accurately position elements and which allows continuous rotation according to the input signal. Details of motor M2 form no part of the present invention.

Spindle 110 is rotatably mounted in journal post 112 and an actuator 114 moves the spindle upwardly to allow loading of the camshaft and downwardly to lock the camshaft in the desired position for processing in accordance with the present invention. Spindle 110 further includes a downwardly extending center 120 adapted to be received in the countersink 30 of the end surface 28 on the camshaft. Drop pin 122 is adapted to be received by bore 32, also on surface 28 so that when pin 122 drops into bore 32, spindle 110 can rotate the camshaft through accurately controlled angles determined by the energizing of drive motor M2.

Lower head 102 is schematically illustrated as having a rotatable center 110 which will allow rotation of camshaft C about axis x when the camshaft is driven by motor M2. Details of lower head 102, as used in practice, are shown in FIG. 10, wherein center 130 is a reciprocal center l30A having a biasing spring 134. Rotatable spindle 140 is supported in lower plate 74 by roller bearings, one of which is shown as roller bearing 144 in FIG. 10. Bellville springs 150 are mounted on the end of shaft 152 and are held in position by nut 154. Nut 154 adjusts the pressure exerted by springs 150 against washer 156 to provide a controlled resistive torque exerted by upper spindle surface 160 against lower end surface or bottom surface 40 of camshaft 30. Countersink 42 receives center l30A. The vertical position of surface 160 is controlled by the vertical position of spindle 140. Pressure by nut 154 determines the amount of force necessary to rotate spindle 140 by camshaft C when it is indexed or rotated by motor M2. The reason for this friction is to allow drop pin 122 to engage bore 32 during initial locating of the camshaft which concept will be explained later. This location procedure also involves the structure shown in FIG. 2 wherein a movable platen or shuttle 170 is reciprocally mounted to be moved by cylinder 172 toward lower bearing 18 during the initial locating process. Platen or shuttle 170 carries a proximity switch or detector 170 having an output line 182. V-notch 190 is a locator arrangement. By engaging the V-notch with surface 18, proximity switch or detector 180 is at a known position with respect to the surface 22 of cam 20 directly adjacent lower bearing surface 18. This is better shown in FIG. 7A. At this same position, a mechanical stamp or marker 200 is illustrated. This marker includes a ram 202 driven toward the portion of the camshaft to indicate that the camshaft has been processed. V-notch 190 can be formed of a breaking substance to perform the function of the Bellville springs in FIG. 10; however, in the preferred embodiment, the V-shaped notch is used only for proximity switch positioning for detection of the lobe during the initial loading operation.

FIG. 3 illustrates the output of proximity switch 180 as it appears in line 82 when shaft C is rotated. The output in line 182 detects the presence of lobe 26 on the cam surface adjacent bearing 118. By determining the angular positions of the first signal caused by the cam lobe and the last signal caused by the lobe, and then dividing the distance between these positions by two, the location of the specific lobe is determined. If a proximity switch is used, the angular position when the switch is turned on by the lobe and the angular position of the time when the switch is turned off by removal of the lobe are recorded and divided by two to produce the actual angular position of the lobe on the particular cam adjacent bearing 18. Of course, this same reading could be taken on any known cam but, in the preferred embodiment, it is taken upon this lower cam for the purposes of simplifying the total operation of device D.

Figure 5:
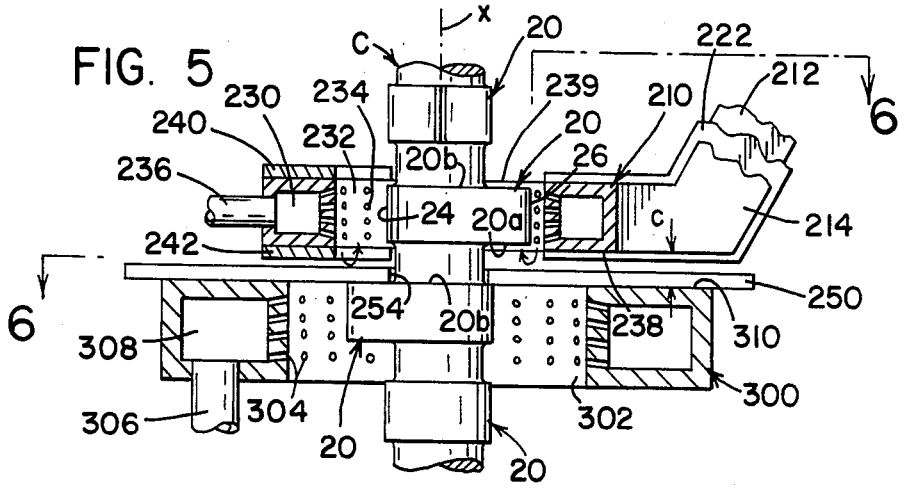
FIG. 5 is an enlarged, cross-sectional view showing the integral quench, cooling assembly and plate concept employed in the present invention.
Figure 6:
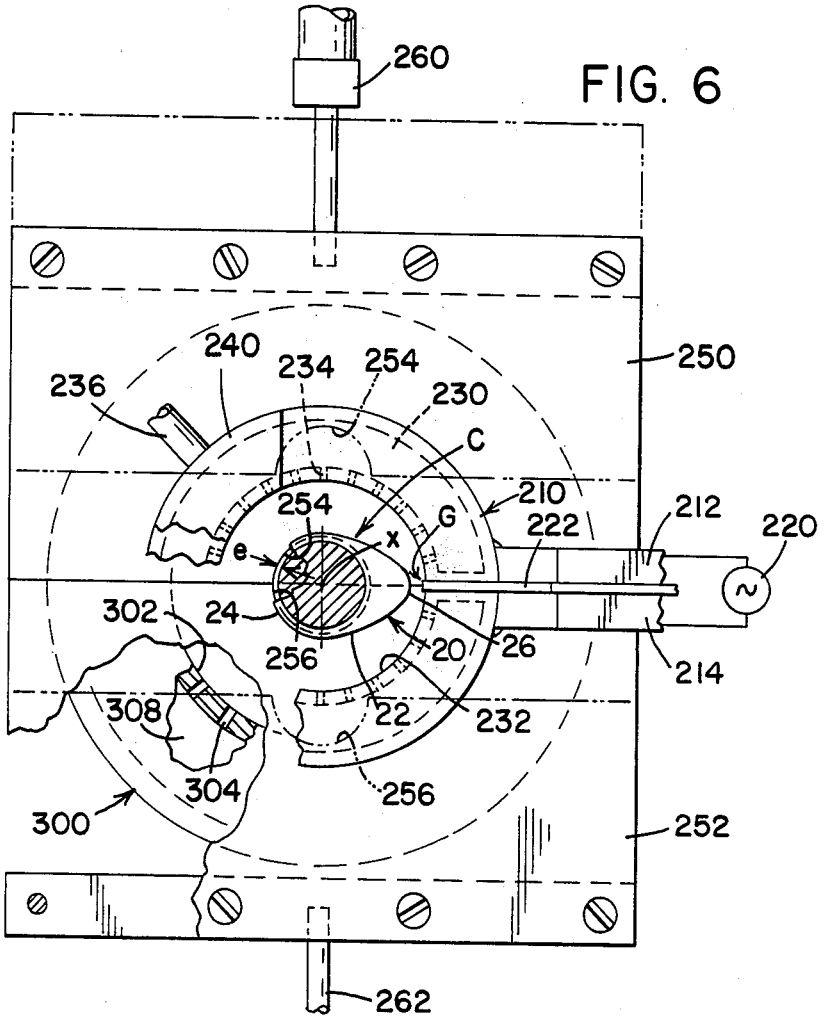
FIG. 6 is a view taken generally along line 6—6 of FIG. 5 with several partial cutaways to illustrate certain concepts of the assembly shown in FIG. 5.

Referring now to FIGS. 5 and 6, induction heating coil 210 is the integral quench type having input leads 212, 214 connected across power supply 220. In practice, this power supply is a solid state inverter having a frequency of between 10 KHz–25 KHz and sufficient power to create at least about 20 KW/in$^2$ of energy at surface 22 of the cams as they are being inductively heated by coil 210. Leads 212, 214 are separated by insulation material or layer 222 to define a gap G known as the "fishtail". An annular quench chamber 230 behind inner cylinder surface 232 of coil 210 directs quenching fluid outwardly toward axis x through quench openings 234. Quenching fluid is introduced into chamber 230 through an appropriate supply line 236 which is supplied at relatively high volume to quench surface 22 of cam 20 after it has been inductively heated by coil 210. Quenching is at a lower velocity to decrease distinct jet action at the heated surface. An arcuately shaped flux concentrator formed from a high permeability material such as Ferrcon is shown as upper and lower elements 240, 242, respectively. This material is bonded ferrous particles and is commonly used in induction heating. These flux concentrater elements circumscribe substantially less than 180° around surface 232 to cause increased heating adjacent heel 24 of cam 20 being heated. The amount of flux concentration material, if any, is determined by the pattern P to be obtained in cam surface 22, as shown in FIG. 4. Immediately below inductor 210 are a pair of reciprocally mounted plates 250, 252 selectively movable toward axis x by appropriate operating cylinders 260, 262, respectively. Semi-circular recesses 254, 256 tightly surround shaft C in the area between a bearing or cams so that movement of plates 250, 252 toward axis x provide a small spacing e shown in FIG. 6, which is no greater than about 0.10 inches. Plates 250, 252 are as close as possible below coil 210 so that they cause a lower cavitation effect from quenching liquid issuing through openings 234. This causes a flooding during a quenching operation in a rapid fashion to rapidly quench out surface 22 after it has been inductively heated by coil 210. In some instances, plates 250, 252 are just below the surface of coil 210 and have an axial thickness determined by the inner edge of flux concentrator 240, as shown in FIG. 5. The object of the plates is to bring the plates as close as possible to the lower surface of the induction heating coil so that they assist in the actual quenching operation. This enhances the efficiency of the quenching operation, especially in view of the need for immediate quenching when high power and low cycle times are employed, as anticipated by the present invention.

Immediately below plates 250, 252 is a cooling assembly 300 having an inner cylindrical surface 302 spacing axis x and including a plurality of relatively large fluid openings 304 adapted to pass quenching or cooling fluid from inlet conduit or supply 306 communicated with an annular chamber 308. Plates 250, 252 can rest upon the upper surface of cooling chamber 300 to reduce the distance c between the lower edge of induction heating coil 210 and the upper edge of cooling assembly 300, as shown in FIG. 5. This distance c is reduced to the necessary amount determined by the close proximity between adJacent cams 20 as shown in FIG. 5. Distance c is selected so that the lower surface 238 of coil 210 is below the lower edge 20A of cam 20. The height of surface 232 is such that the lower spacing between surface **20*a* and lower coil surface 238 is substantially as great as the spacing between the upper face or surface 20*b* and the upper face or surface 239 of coil 210. At least, the spacing c is maintained such that face 232 extends above and below surface 22 of cam 20 as it is being heated. Further, the upper surface 310 of cooling assembly 300 is adjacent to or above the upper face or surface 20*b* of cam 20 in cooling assembly 300, as shown in FIG. 5**. As can be seen, distance c is relatively small and is as close as possible to accomplish the geometric objectives discussed above.

The operation of apparatus B as so far described is now apparent from the showings of FIG. 7A–7H. Upper head 100 is retracted by actuator 114. A robot, not shown, loads camshaft C in the position shown in FIG. 1. Countersink 42 of lower surface 40 at bearing 18 is positioned over the upwardly extending 130 or **130*a*. The process is then accomplished as shown in the block diagram of FIG. 11. After the loading procedure, the machine identifies the shaft. This is done automatically when different shafts are being provided to the machine; however, in practice a fixed shaft is to be processed; therefore, no identification is needed. After the shaft is in position, it is forced downwardly by actuator 114. This forces lower surface 40 against upper fixed surface 160 shown in FIG. 10. Center 130*a* is biased into countersink 42 so that the cam is located between lower center and upper center 120. Motor M2 is then rotated. Springs 150 exert a resistance to rotation of spindle 140. The force between surfaces 40, 160 as shown in FIG. 10, causes a resistance torque to be exerted on cam C. Consequently, upper spindle 110 rotates with respect to upper surface 28 of camshaft C. This relative movement continues until pin 122 drops into bore 32. This action locks spindle 110 with camshaft C and overcomes the resistance caused by springs 150. Thereafter, the camshaft moves with spindle 110** during processing of camshaft.

Figure 7A:
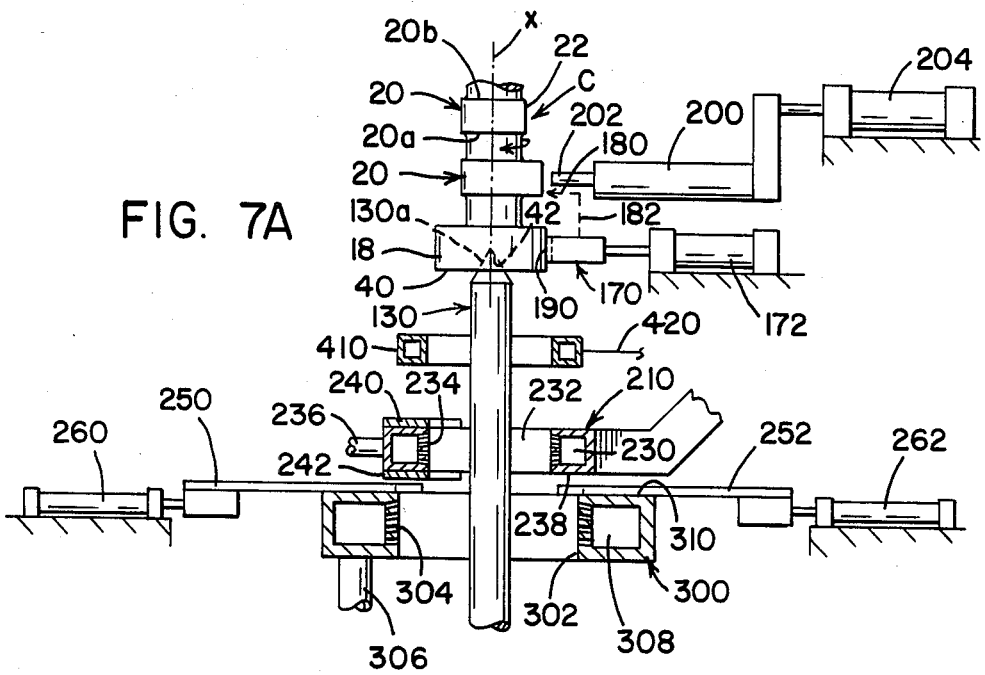
FIG. 7A–7H are views showing various steps through which the mechanism and method process for the purposes of processing camshafts in accordance with the invention.

Referring again to FIG. 11, rotation of the upper head causes the pin to drop into place. Thereafter, as shown in FIG. 7A, proximity switch 180 carried on platen or shuttle 170 detects the center of the lobe 26 on the particular cam 20 just above bearing 18. This location determines the angular disposition of camshaft C with respect to the output of motor M2 or, otherwise, spindle 110. This information sets the program which has already identified the processing steps for the total processing of cam C in accordance with standard software concepts using a micro-processor system schematically disclosed in FIG. 9. Marker 200 drives ram 202 against the camshaft, but not the cam surface, for the purpose of marking the cam as having been processed. The location of this ram is selected to mark a position between a cam which cannot be illustrated because the closeness of the structures illustrated in the drawings.

Figure 7B:
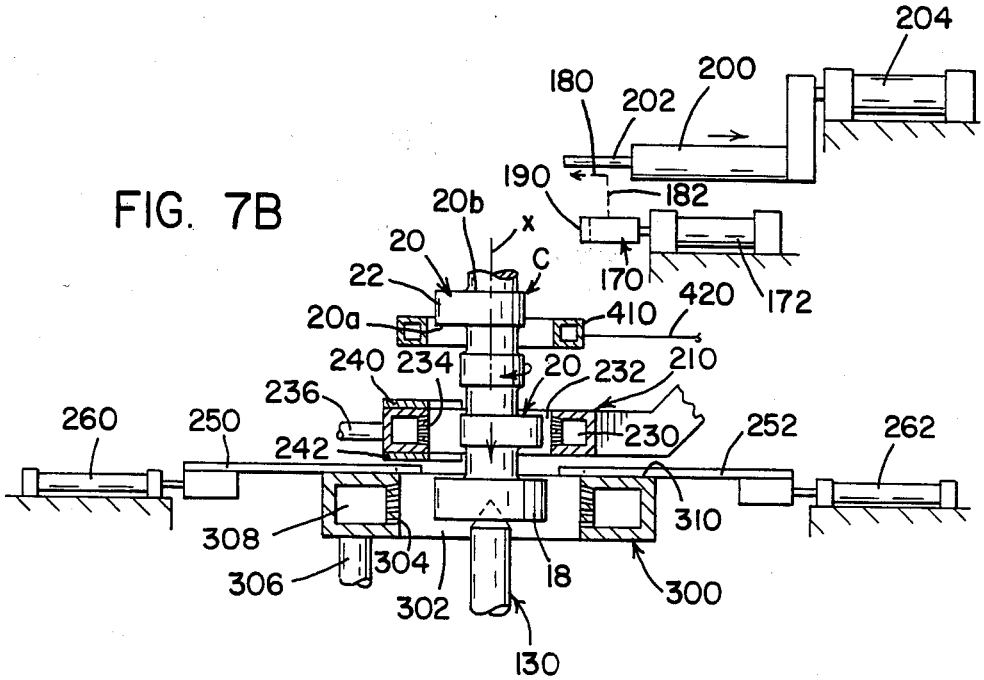
Figure 7C:
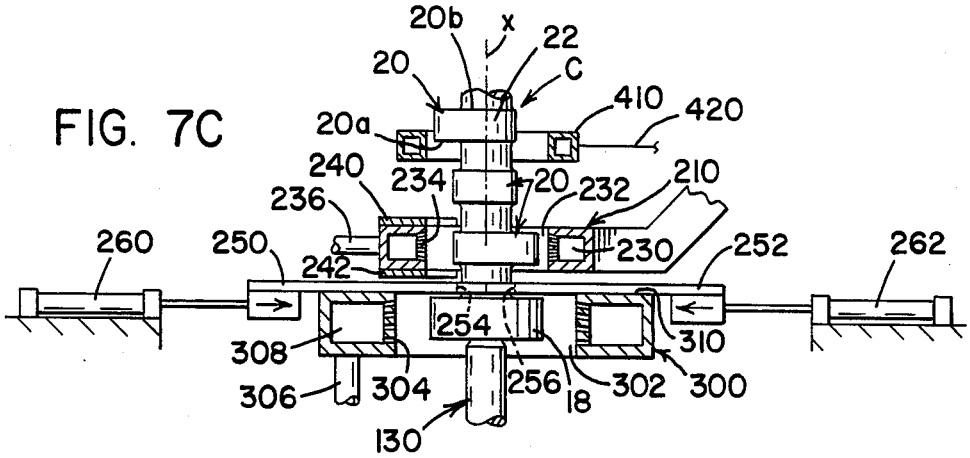
Figure 7D:
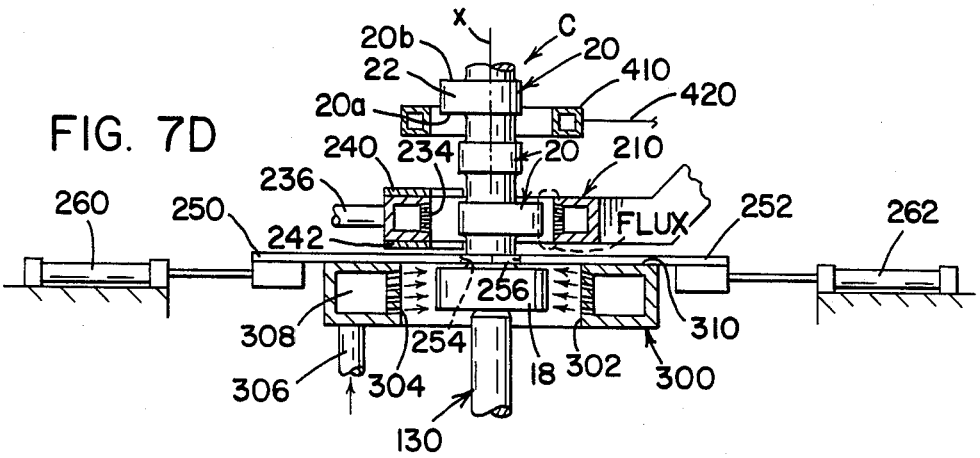
Figure 7E:
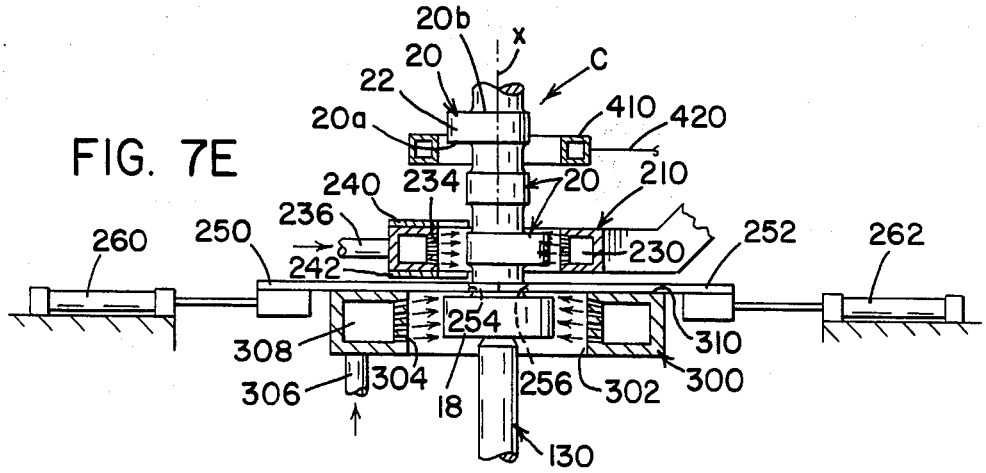

Thereafter, marker 200 and platen 170 are withdrawn. This is illustrated in FIG. 7B. Motor M1 indexes shaft C downward until the next adjacent cam 20 is within heating coil 210. This is also shown in FIG. 7B. At that time, plates 250, 252 are moved inwardly as shown in FIG. 7C. In FIG. 7D, the heating cycle commences. This is shown by flux lines at inductor 210. This heating cycle, as explained earlier, is preferably about 1.0 seconds in length creates a power density in the neighborhood of 50 KW/in$^2$ and has a frequency of preferably 10 KHz. Before the heating cycle occurs, motor M2 indexes shaft C circumferentially until lobe 26 is adjacent gap G, as shown in FIG. 6. During this heating cycle, fluid is forced against lower bearing 18 which has not been hardened. In this manner, heat in the bearing is minimized. Indeed, it is possible not to cool at this particular processing step. Referring now to FIG. 7E, the integral quench directs liquid (a polymer quench) toward cam 20 from chamber 230. This occurs immediately and provides a general flooding of the heated surface with somewhat reduced jet action. The lower plates 250, 252 prevent down flushing of liquid to hold liquid within the cylindrical cavity defined by the inner surface of inductor 210 to rapidly cool surface 22 of cam 20 through the critical hardness temperature. As illustrated in this view, the lower cooling chamber maintains its flow of liquid toward bearing 18.

Figure 7F:
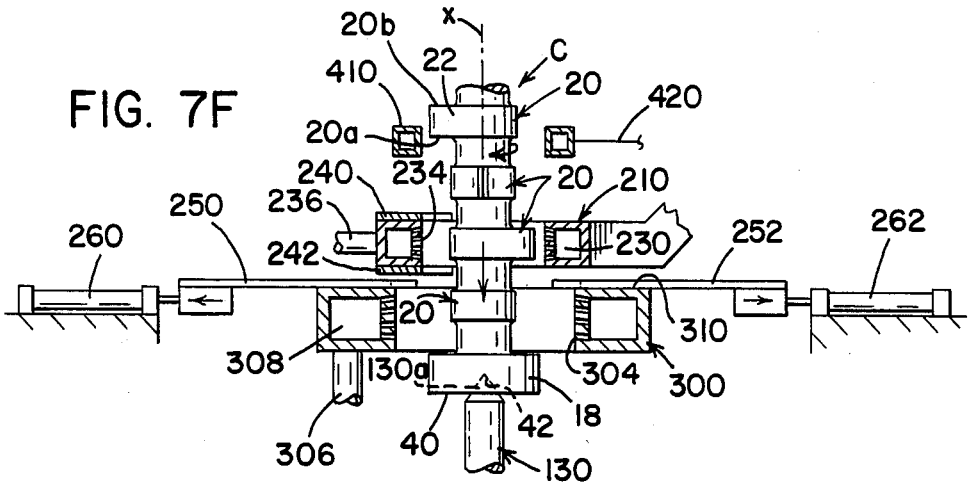
Figure 7H:
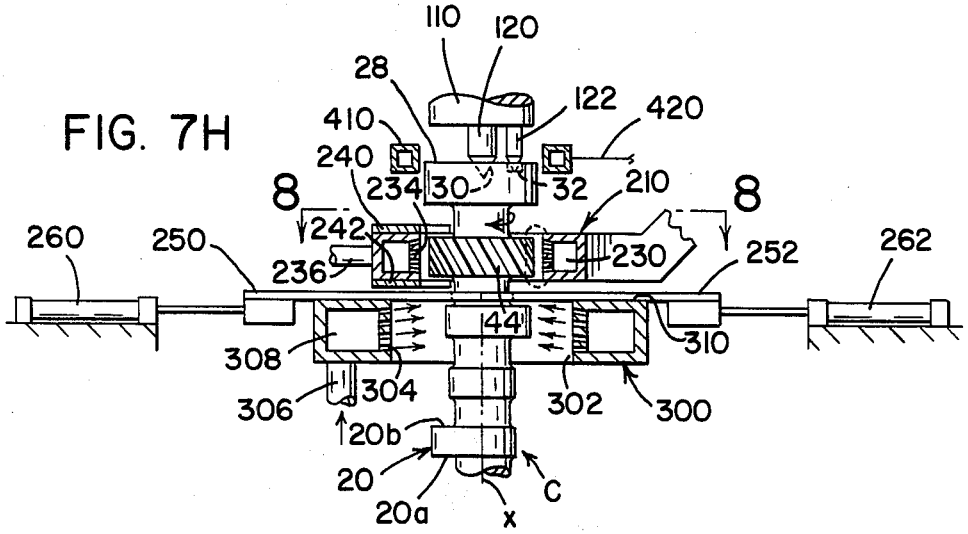
Figure 7G:
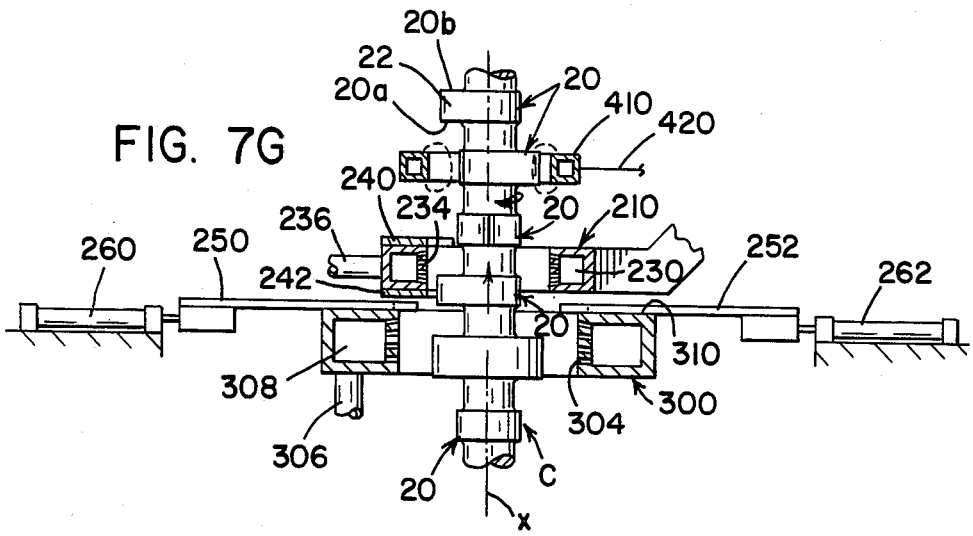
Figure 8:
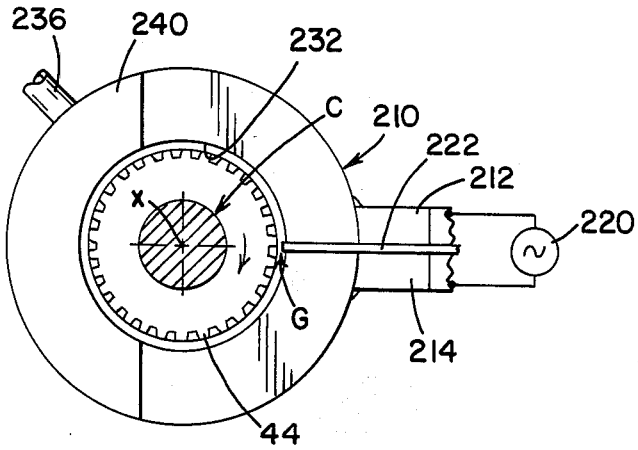
FIG. 8 is a top view illustrating the induction heating coil as used to heat a rotating workpiece, such as the fuel pump gear of camshafts.

Turning now to FIG. 7F, plates or shields 250, 252 are retracted. Motor M1 indexes the hardened lower cam into the cooling assembly and brings an unhardened cam into the induction heating coil 210. Also, motor M2 rotates camshaft C until the cam is in the proper indexed position as shown in FIG. 6. Thereafter, plates 250, 252 are moved into their engaging position and the process is repeated as indicated in the block diagram of FIG. 11. First, the hardened cam is flooded by the cooling assembly. The next cam is then inductively heated and quench hardened. This continuing operation is illustrated in FIG. 7C. At the end of the cycle, as illustrated in FIG. 7H and FIG. 8, fuel pump gear 44 is moved into coil 210. Motor M2 rotates spindle 210 continuously while gear 44 is inductively heated and then quench hardened. Rotation is appropriate here since gear 44 is circular in shape and requires rotation to prevent ununiformity adjacent gap G as shown in FIG. 8.

Figure 11:
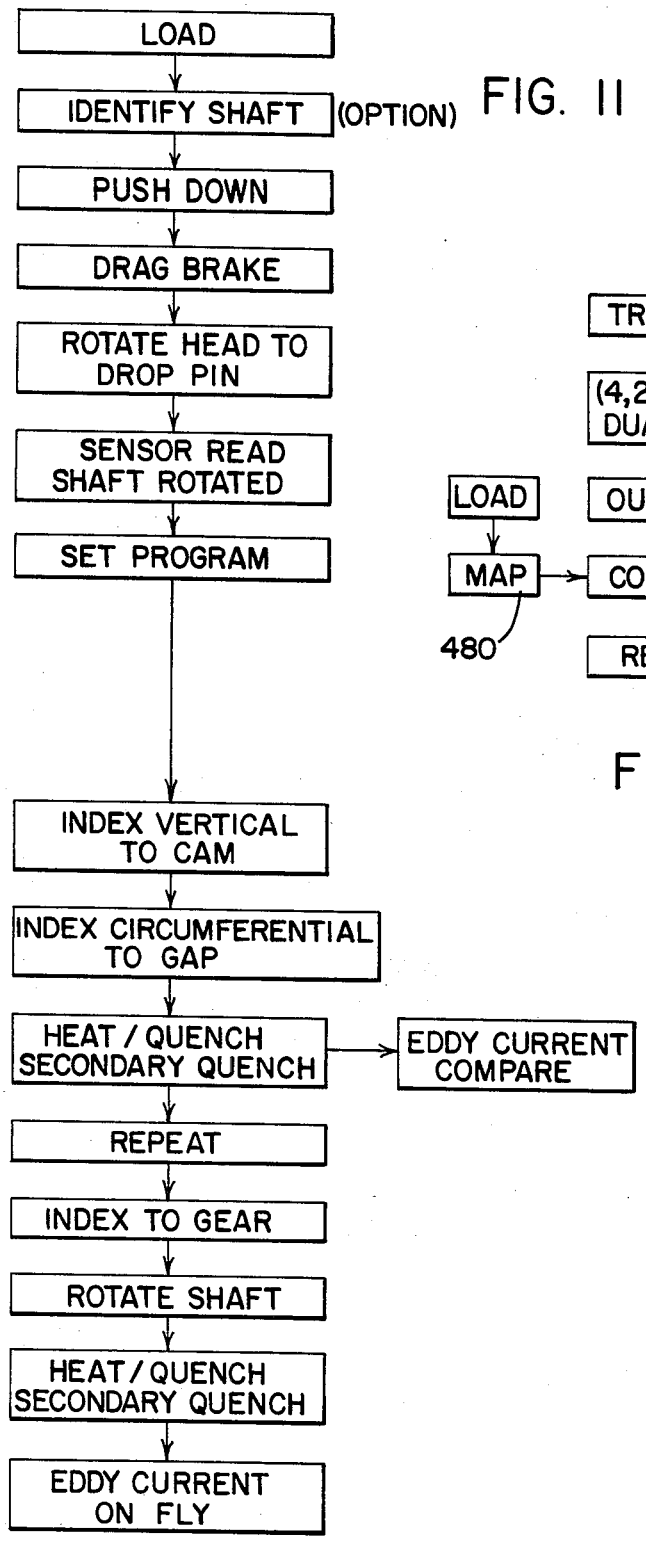
FIG. 11 is a block diagram showing the processing steps employed in the present invention.

As shown in FIG. 11, all cam surfaces have now been hardened on shaft C. The shaft has been shifted downwardly through the heating coil to the place where spindle 110 is adjacent coil 210 as shown in FIG. 7H. The shaft could be removed and tested in a separate arrangement as shown in prior application by Balzer, Ser. No. 769,399, filed Aug. 26, 1985. In accordance with an aspect of the present invention, the testing is done while shafts C, C' are still in device D by an eddy current arrangement which will be explained later.

Turning again to the reciprocal plates 250, 252 best shown in FIGS. 5 and 6, these plates are formed from a relatively thin (0.20–0.40 inches) electrically insulating, electrically nonconductive material. Such material is a glass based laminant with high temperature binder, such as "G10". This material does not concentrate or direct flux lines created during the heating portion of the hardening cycle for a cam surface. Using this material and bringing the plates upwardly close to the bottom of coil 210, enhances the quenching operation by the coil, as well as preventing cooling liquid used in cooling assembly 300 from engaging surface 22 during induction heating. This feature is unique, in combination with the high frequency, high power and short heating time for the heating portion of the hardening cycle. All of these parameters limit the amount of energy into the surface during the heating cycle, limits the depth of heating and allows rapid quench hardening to produce a relatively controlled, shallow hardness pattern P, as shown in FIG. 4. The quenching liquid is a water based polymer which enhances the quenching operation by removing heat rapidly from surface 22 after it has been inductively heated. Openings 234 for quenching are enlarged to allow a low velocity inductor quench impingement to create a flooding quench action on the cam surface, which is assisted by the lower movable plates 250, 252. Normal high velocity quenching causes certain variations in the relatively highly controlled heating pattern. This shows the advantage of the movable shields. Should the camshaft be heated in a horizontal position, a shield could be placed on both sides of inductor 210.

Figure 12:
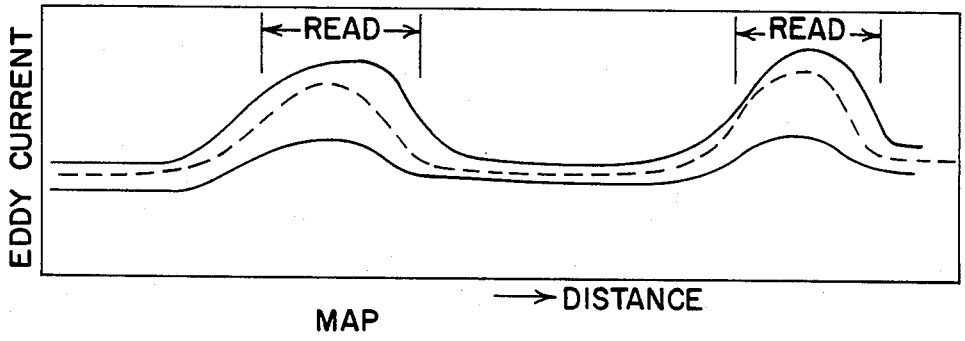
FIGS. 12 and 12A are eddy current mapping arrangements which illustrated the operating characteristics of the eddy current testing device constructed in accordance with the present invention; and, FIG. 13 is a partial plan view showing certain aspects of the eddy current testing device used in the preferred embodiment of the present invention.
Figure 12A:
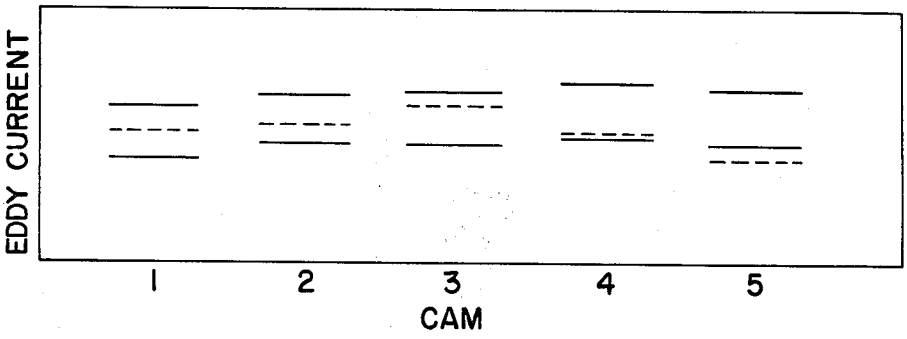
Figure 13:
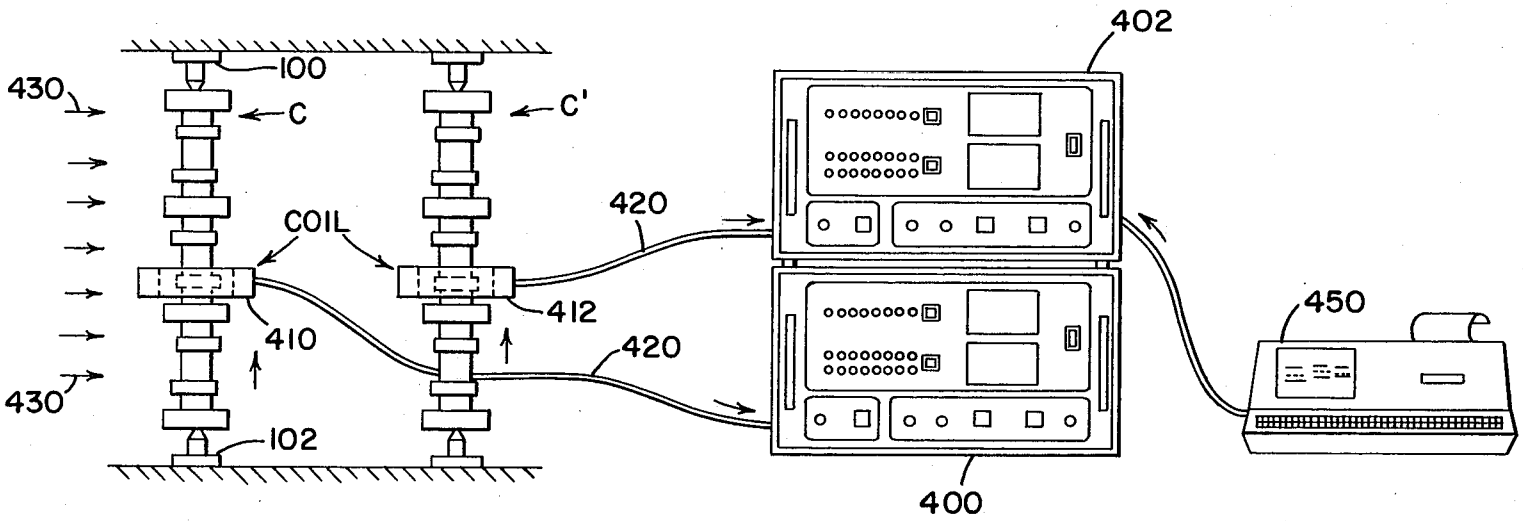

After all camshaft surfaces 22 have been hardened in accordance with the desired pattern represented in FIG. 4, camshaft C will be in the lower position as shown in FIG. 7H. Thereafter, all surfaces are sequentially tested with known eddy current technology such as illustrated in Mordwinkin U.S. Pat. No. 4,059,795 and Mordwinkin U.S. Pat. No. 4,230,987. Other eddy current testing devices are available such as from Hentschel Instruments, Inc. in Ann Arbor, Mich. These devices schematically represented, as eddy current units 400, 402, apply high frequency through eddy current testing coils 410, 414. The eddy current reaction caused by driving these coils is detected through detecting and powering lines 420. As is well known, the eddy current characteristics of the hardened cam surfaces can be detected through appropriate lines 420 to determine metallurgical characteristics. Referring now to FIG. 13, as camshafts are moved progressively in an upward direction, encoder or promptors 420 cause units 400, 402 to sense the metallurgical characteristics at the promptors 430 locate the positions of the various hardened cams. Consequently, the testing is progress, i.e., on-the-fly. As the camshaft moves from the position shown in FIG. 7H in an upward direction, as shown in FIG. 7C, electrical characteristics of coil 410 are read by line 420 at the time coil 410 is adJacent a cam 20. This periodic reading of the output or response of the eddy current coils is compared to a similar reading made on a plurality of camshafts C having physically and manually tested acceptable surface characteristics. When several acceptable camshafts are run through the coil 410, a map is constructed statistically to record the range of acceptable responses from the eddy current coil 410 as it passes each of the various cams on a given camshaft. The camshaft remains stationary; therefore, the maps take in consideration the various circumferential orientations of the particular values constituting a given type of camshaft. The map could be a continuous map, as shown in FIG. 12, or a discontinuous map as shown in FIG. 12 A, both of which indicate ranges of acceptable responses at each cam location. Of course, the promptors 430, shown in FIG. 13, can be program flags and made a part of the map schematically illustrated in FIGS. 12 and 12A. This map, of course, is digitized and need not be visually displayed. In accordance with the preferred embodiment, a video terminal 450, as shown in FIG. 3, is used to display the relationship of a given cam being scanned by the eddy current coil as it is compared with acceptable responses generated by a statistical analysis of acceptable cams tested by hand. As shown in FIG. 12, the dashed line is the output from line 420 of coil 210 during a scanning operation for an acceptable camshaft. As can be seen, the dashed line is read in response to a promptor 430 and remains between upper and lower limits. This is an acceptable cam. The same concept is employed in the graph shown in FIG. 12 wherein promptor 430 causes a reading only at the cam areas and these readings are compared to upper and low limits for these particular cams being tested in response to a promptor signal or designation from promptor 430.

Figure 11A:
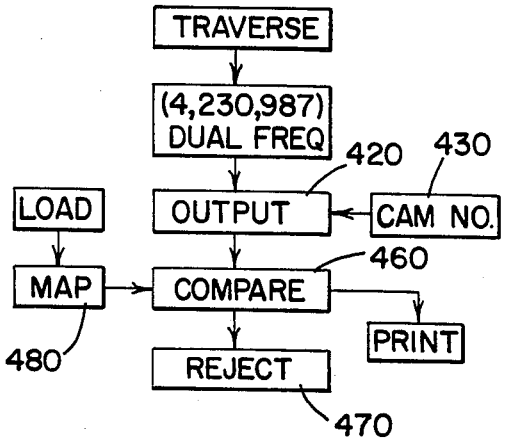
FIG. 11A is a further block diagram showing the concept used in testing the previously hardened cam surfaces on-the-fly by a somewhat standard eddy current detector arrangement, one of which is illustrated in U.S. Pat. No. 4,230,987.

In FIG. 11A, a block diagram of the A current scanning function is set forth. The coil traverses the camshaft. This is accomplished in practice by moving the camshaft with respect to the coil as so far described. A dual frequency eddy current device, such as shown in U.S. Pat. No. 4,230,987, or any other device drives the coil 410 preferably in a continuous fashion. The output 420 is then passed to comparator 430 during a prompting time indicated by box 430. These promptors relate to cams for a particular camshaft. In the comparator operation 460 of the eddy current system, a selected map for the given camshaft is used to determine the acceptability of the responses from lines 420. If the responses are outside of limits, the particular camshaft is rejected as indicated by box 470. The map represented by box 480 is loaded selectively which also determines the promptors 430 for reading the output 420. This particular map is generally fixed in high production situations; however, in low production situations, the cam coming into the device can first be identified either by inditia or physical characteristics. The identified cam has its own map and cam promptors 430 network. The identification concept is an option in the block diagram of FIG. 11. Such identification will set the program for the processing of the camshaft in accordance with FIG. 11 and will also load a selected map 480 into the eddy current subroutine of the program controlling the operation of the eddy current processing and the camshaft hardening procedure.

Figure 9:
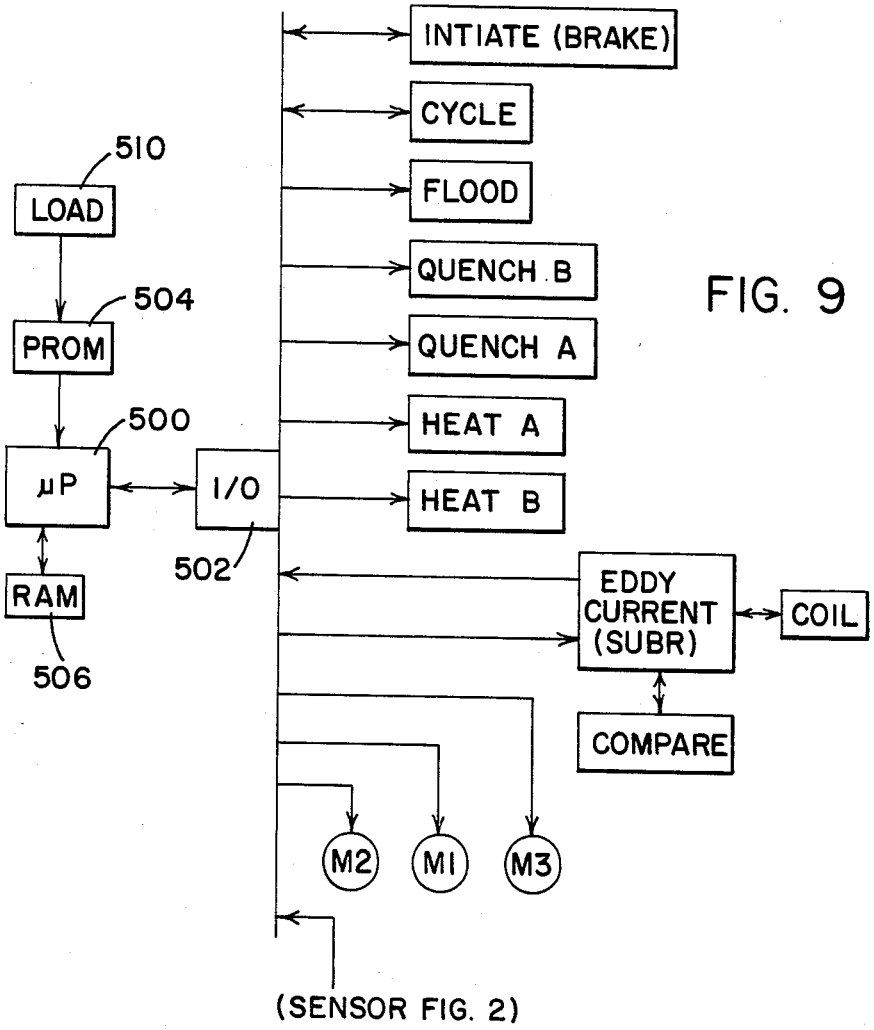
FIG. 9 is a block diagram illustrating the general mirco-processor controlled concept employed in the present invention.

Referring now to FIG. 9, the microprocessor employs a standard I/O interface 502 with a prom 504 and ram 506. As can be seen, the microprocessor controls the various steps so far explained in this device and can include a loadable program 510 for any particular cam. This load program can also include identification subroutine together with a selective loading concept creating a different map shown in FIG. 11A and a different program shown in FIG. 11.

The current embodiment of the invention in the area of the induction coil 210 and cooling assembly 300 is shown in FIGS. 6A and 6B. Upper surface 310 is nearly abutting lower surface 238 of coil 210; therefore, distance c is from the bottom of a diametrically extending groove 500, one for each plate 250, 252. These grooves, only one of which is shown, allow plates 250, 252 to cover the 210 in. diameter opening 502. The rest of surface 310 is near surface 238. Distance c is the about thickness of plates 250, 252, i.e., in practice .125 inches. Pressure P in chamber 230 is in the low range of 15–20 p.s.i. and the openings 234 are in the general larger ranges of 0.60–0.90 inches. The polymer quench liquid is up to about 10% polymer and, preferably, is about 4% polymer. To prevent stray flux from entering the lower cooling chamber a Ferracon layer 510 is placed on the lower surfaces of plates 250, 252 as shown in FIG. 6C.

Having defined the invention, the following is claimed:

1. An apparatus for inductively heating and then quench hardening the surfaces of axially spaced cams on a steel camshaft having a longitudinally extending rotational axis concentric with a plurality of axially spaced bearings with surfaces concentric to said rotational axis, said cams having lobes with differing circumferential locations, said apparatus comprising: means for rotatably mounting said camshaft to rotate about a work axis coinciding with said rotational axis; an induction heating coil having an inner surface surrounding said work axis with an insulation gap and integral quenching openings for directing liquid inwardly from said heating coil toward said work axis; a high frequency power supply means for selectively energizing said heating coil with a power density within said heating coil of over about 20 $KW/in^2$; an auxiliary cooling assembly fixed with respect to said heating coil at an axially spaced position near said heating coil and including means for spraying a cooling liquid toward said work axis; first drive means for causing relative axial movement of said camshaft and said heating coil to position a cam in said heating coil during a hardening cycle, including an induction heating portion and quench hardening portion: second drive means for rotating said camshaft about said work axis; means for controlling said second drive means for selective rotating said camshaft to an indexed position with said cam in said coil having a preselected fixed circumferential orientation during at least said heating portion of said hardening cycle; means for selectively operating said power supply means during said heating portion of said cam hardening cycle; means for selectively operating said cooling assembly during at least said heating portion of said hardening cycle for a cam in said heating coil; control means for repeatedly operating said first drive means, said second drive means, power supply operating means, said cooling assembly operating means for axially indexing a further cam into said fixed orientation within said heating coil for hardening during a hardening cycle while a previously, axially adJacent, hardened cam is cooled in said cooling assembly; and means for preventing splashing of cooling liquid onto said cam in said heating coil during said heating portion of said hardening cycle.

2. An apparatus as defined in claim 1 where said index position is with the lobe of said cam in said coil is adjacent said insulating gap.

3. An apparatus as defined in claim 2 wherein said splash preventing means includes a shield and means for selectively moving said shield between said heating coil and said cooling assembly at least during said heating portion of said hardening cycle.

4. An apparatus as defined in claim 3 including an eddy current detecting means for detecting the hardened quality of said cams after said cams have been sequentially hardened, said eddy current detecting means comprising an eddy current coil concentric with said work axis, means for progressively moving said eddy current coil along said cam shaft, means for energizing said eddy current coil at least at each of said axially spaced cams; means for reading the eddy current responses of said energized eddy current coil at each of said hardened cams; means for comparing said eddy current response with a preselected map of acceptable responses; and means for rejecting a camshaft when said eddy current responses deviate from said preselected map of acceptable responses.

5. An apparatus as defined in claim 3 wherein said heating coil has an element of high permeability material diametrically opposite to said insulating gap whereby the portion of the surface of said cam opposite to the lobe of said cam has enhanced heating during said heating portion of said hardening cycle.

6. An apparatus as defined in claim 3 wherein said axis is vertical and said cooling assembly is axially below said heating coil.

7. An apparatus as defined in claim 3 including a second heating coil and cooling assembly concentric with a second work axis parallel to said first mentioned work axis and means for mounting a second of said camshafts on said second work axis and means for sequentially hardening the cams of said second camshaft in unison with cams of said first mentioned camshaft.

8. An apparatus as defined in claim 2 including an eddy current detecting means for detecting the hardened quality of said cams after said cams have been sequentially hardened, said eddy current detecting means comprising an eddy current coil concentric with said work axis, means for progressively moving said eddy current coil along said cam shaft, means for energizing said eddy current coil at least at each of said axially spaced cams; means for reading the eddy current responses of said energized eddy current coil at each of said hardened cams; means for comparing said eddy current response with a preselected map of acceptable responses; and means for rejecting a camshaft when said eddy current responses deviate from said preselected map of acceptable responses.

9. An apparatus as defined in claim 8 wherein said heating coil has an element of high permeability material diametrically opposite to said insulating gap whereby the portion of the surface of said cam opposite to the lobe of said cam has enhanced heating during said heating portion of said hardening cycle.

10. An apparatus as defined in claim 2 further including orientating means for rotating said camshaft before the first of said hardening cycles while a position sensor means is adjacent a selected one of said cams, said sensor means having an output indicative of the radial dimension of the surface of said selected one of cams; detector means for determining the circumferential location of the lobe of said selected one of said cams; and, means for controlling said control means by said determined lobe location.

11. An apparatus as defined in claim 10 wherein said heating coil has an element of high permeability material diametrically opposite to said insulating gap whereby the portion of the surface of said cam opposite to the lobe of said cam has enhanced heating during said heating portion of said hardening cycle.

12. An apparatus as defined in claim 2 wherein said heating coil has an element of high permeability material diametrically opposite to said insulating gap whereby the portion of the surface of said cam opposite to the lobe of said cam has enhanced heating during said heating portion of said hardening cycle.

13. An apparatus as defined in claim 12 wherein said axis is vertical and said cooling assembly is axially below said heating coil.

14. An apparatus as defined in claim 12 including a second heating coil and cooling assembly concentric with a second work axis parallel to said first mentioned work axis and means for mounting a second of said camshafts on said second work axis and means for sequentially hardening the cams of said second camshaft in unison with cams of said first mentioned camshaft.

15. An apparatus as defined in claim 2 wherein said axis is vertical and said cooling assembly is axially below said heating coil.

16. An apparatus as defined in claim 2 including a second heating coil and cooling assembly concentric with a second work axis parallel to said first mentioned work axis and means for mounting a second of said camshafts on said second work axis and means for sequentially hardening the cams of said second camshaft in unison with cams of said first mentioned camshaft.

17. An apparatus as defined in claim 2 wherein said camshaft has a gear concentric with said axis and including means for axially moving said camshaft until said gear is within said heating coil and means for then rotating said camshaft while said gear is in said heating coil and means for actuating said selectively operating means for said power supply as said gear rotates in said heating coil.

18. An apparatus as defined in claim 1 wherein said splash preventing means includes a shield and means for selectively moving said shield between said heating coil and said cooling assembly at least during said heating portion of said hardening cycle.

19. An apparatus as defined in claim 18 including an eddy current detecting means for detecting the hardened quality of said cams after said cams have been sequentially hardened, said eddy current detecting means comprising an eddy current coil concentric with said work axis, means for progressively moving said eddy current coil along said cam shaft, means for energizing said eddy current coil at least at each of said axially spaced cams; means for reading the eddy current responses of said energized eddy current coil at each of said hardened cams; means for comparing said eddy current response with a preselected map of acceptable responses; and means for rejecting a camshaft when said eddy current responses deviate from said preselected map of acceptable responses.

20. An apparatus as defined in claim 18 further including orientating means for rotating said camshaft before the first of said hardening cycles while a position sensor means is adjacent a selected one of said cams, said sensor means having an output indicative of the radial dimension of the surface of said selected one of cams; detector means for determining the circumferential location of the lobe of said selected one of said cams; and, means for controlling said control means by said determined lobe location.

21. An apparatus as defined in claim 1 including an eddy current detecting means for detecting the hardened quality of said cams after said cams have been sequentially hardened, said eddy current detecting means comprising an eddy current coil concentric with said work axis, means for progressively moving said eddy current coil along said cam shaft, means for energizing said eddy current coil at least at each of said axially spaced cams: means for reading the eddy current responses of said energized eddy current coil at each of said hardened cams: means for comparing said eddy current response with a preselected map of acceptable responses; and means for rejecting a camshaft when said eddy current responses deviate from said preselected map of acceptable responses.

22. An apparatus as defined in claim 21 further including orientating means for rotating said camshaft before the first of said hardening cycles while a position sensor means is adjacent a selected one of said cams, said sensor means having an output indicative of the radial dimension of the surface of said selected one of cams; detector means for determining the circumferential location of the lobe of said selected one of said cams; and, means for controlling said control means by said determined lobe location.

23. An apparatus as defined in claim 21, wherein said axis is vertical and said cooling assembly is axially below said heating coil.

24. An apparatus as defined in claim 1 further including orientating means for rotating said camshaft before the first of said hardening cycles while a position sensor means is adjacent a selected one of said cams, said sensor means having an output indicative of the radial dimension of the surface of said selected one of cams; detector means for determining the circumferential location of the lobe of said selected one of said cams and, means for controlling said control means by said determined lobe location.

25. An apparat defined in claim 24 wherein said axis is vertical and said cooling assembly is axially below said heating coil.

26. An apparatus as defined in claim 24 including a second heating coil and cooling assembly concentric with a second work axis parallel to said first mentioned work axis and means for mounting a second of said camshafts on said second work axis and means for sequentially hardening the cams of said second camshaft in unison with cams of said first mentioned camshaft.

27. An apparatus as defined in claim 24 wherein said camshaft has a gear concentric with said axis and including means for axially moving said camshaft until said gear is within said heating coil and means for then rotating said camshaft while said gear is in said heating coil and means for actuating said selectively operating means for said power supply as said gear rotates in said heating coil.

28. An apparatus as defined in claim 1 wherein said axis is vertical and said cooling assembly is axially below said heating coil.

29. An apparatus as defined in claim 28 including a second heating coil and cooling assembly concentric with a second work axis parallel to said first mentioned work axis and means for mounting a second of said camshafts on said second work axis and means for sequentially hardening the cams of said second camshaft in unison with cams of said first mentioned camshaft.

30. An apparatus as defined in claim 1 including a second heating coil and cooling assembly concentric with a second work axis parallel to said first mentioned work axis and means for mounting a second of said camshafts on said second work axis and means for sequentially hardening the cams of said second camshaft in unison with cams of said first mentioned camshaft.

31. An apparatus as defined in claim 1 wherein said camshaft has a gear concentric with said axis and including means for axially moving said camshaft until said gear is within said heating coil and means for then rotating said camshaft while said gear is in said heating coil and means for actuating said selectively operating means for said power supply as said gear rotates in said heating coil.

32. An apparatus as defined in claim 1 wherein said camshaft as an axially facing end surface with a center countersink on said rotational axis and an axially space locating hose wherein said second drive means includes a motor driven head having a center engaging said countersink and a radially outwardly spaced shaft drivepin engageable with said end surface and adapted to drop into said hose while said center engage said countersink and means for applying resistive torque to said shaft as said driven head rotates at least until said drivepin drops into said locating hose.

33. An apparatus as defined in claim 32 wherein said torque applying means include a rotatable head for supporting said shaft at an end opposite to said end surface and means for applying a resistive force against rotation of said rotatable head.

34. An apparatus as defined in claim 32 wherein said torque applying means includes a drag brake and means for selectively moving said brack radially against said camshaft.

35. An apparatus for inductively heating and then quench hardening axially spaced cams on a steel camshaft having a longitudinally extending rotational axis concentric with a plurality of axially spaced bearings with surfaces concentric to said rotational axis, said apparatus comprising: means for rotatably mounting said camshaft to rotate about a work axis coinciding with said rotational axis; an induction heating coil having an inner surface surrounds said work axis with an insulation gap and integral quenching openings for directing liquid inwardly from said heating coil toward said work axis; a high frequency power supply means for selectively energizing said heating coil with a power density within said heating coil of over about 20 $KW/in^2$; an axially cooling assembly fixed with respect to said coil at an axially spaced position near said heating coil and including means for spraying a cooling liquid toward said work axis; first drive means for causing relative axial movement of said camshaft and said heating coil to position a cam in said heating coil during a hardening cycle, including an induction heating portion and quench hardening position; second drive means for rotating said camshaft about said work axis; means for controlling said second drive means for selective rotating said camshaft to an indexed position with said cam in said coil having a preselected fixed circumferential orientation during at least said heating portion of said hardening cycle; means for selectively operating said power supply means during said heating portion of said cam hardening cycle; means for selectively operating said cooling assembly during said at least said heating portion of said hardening cycle for a cam in said heating coil; control means for repeatedly operating said first drive means, said second drive means, power supply operating means, said cooling assembly operating means for axially indexing a further cam into said fixed orientation within said heating coil for hardening during a hardening cycle while a previously, axially adjacent, hardened cam is cooled in said cooling assembly; and, said indexed position is with the lobe of said cam in said coil being adjacent said insulating gap

36. An apparatus as defined in claim 35 including a shield and means for selectively moving said shield between said heating coil and said cooling assembly at least during said heating portion of said hardening cycle.

37. An apparatus as defined in claim 36 including an eddy current detecting means for detecting the hardened quality of said cams after said cams have been sequentially hardened, said eddy current detecting means comprising an eddy current coil concentric with said work axis, means for progressively moving said eddy current coil along said camshaft, means for energizing said eddy current coil at least at each of said axially spaced cams; means for reading the eddy current responses of said energized eddy current coil at each of said hardened cams; means for comparing said eddy current response with a preselected map of acceptable responses; and means for rejecting a camshaft when said eddy current responses deviate from said preselected map of acceptable responses.

38. An apparatus as defined in claim 35 further including orientating means for rotating said camshaft before the first of said hardening cycles while a position sensor means is adjacent a selected one of said cams, said sensor means having an output indicative of the radial dimension of the surface of said selected one of cams: detector means for determining the circumferential location of the lobe of said selected one of said cams; and, means for controlling said control means by said determined lobe location.

39. An apparatus as defined in claim 35 wherein said heating coil has an element of high permeability material diametrically opposite to said insulating gap whereby the portion of the surface of said cam opposite to the lobe of said cam has enhanced heating during said heating portion of said hardening cycle.

40. An apparatus as defined in claim 35 wherein said axis is vertical and said cooling assembly is axially below said heating coil.

41. An apparatus as defined in claim 35 including a second heating coil and cooling assembly concentric with a second work axis parallel to said first mentioned work axis and means for mounting a second of said camshaft on said second work axis and means for sequentially hardening the cams of said second camshaft in unison with cams of said first mentioned camshaft.

42. An apparatus for inductively heating and then quench hardening axially spaced cams on a steel camshaft having a longitudinally extending rotational axis concentric with a plurality of axially spaced bearings with surfaces concentric to said rotational axis, said apparatus comprising: means for rotatably mounting said camshaft to rotate about a work axis coinciding with said rotational axis; an induction heating coil having an inner surface surrounding said work axis with an insulation gap and integral quenching openings for directing liquid inwardly from said heating coil toward said work axis; a high frequency power supply means for selectivity energizing said heating coil with a power density within said heating coil of over about 20 $KW/in^2$; an auxiliary cooling assembly fixed with respect to said heating coil at an auxiliary spaced position near said heating coil and including means for spraying a cooling liquid toward said work axis, first drive means for causing relative axial movement of said camshaft and said heating coil to position a cam in said heating coil during a hardening cycle, including an induction heating portion and quench hardening portion; second drive means for rotating said camshaft about said work axis; means for controlling said second drive means for selective rotating said camshaft to an indexed position with said cam in said coil having a preselected fixed circumferential orientation during at least said heating portion of said hardening cycle; means for selectively operating said power supply means during said heating portion of said cam hardening cycle; means for selectively operating said cooling assembly during at least said heating portion of said hardening cycle for a cam in said heatiang coil; control means for repeatedly operating said first drive means, said second drive means, power supply operating means, said cooling assembly operating means for axially indexing a further cam into said fixed orientation within said heating coil for hardening during a hardening cycle while a previously, axially adjacent, hardened cam is cooled in said cooling assembly; and, eddy current detecting means for detecting the hardened quality of said cams after said cams have been sequentially hardened, said eddy current detecting means comprising an eddy current coil concentric with said work axis, means for progressively moving said eddy current coil along said camshaft, means for energizing said eddy current coil at least at each of said axially spaced cams; means for detecting the eddy current induced by said energized eddy current coil in each of said hardened cams; means for comparing the values of said detected eddy currents with a preselected map of acceptable values; and means for rejecting a camshaft when said eddy currents deviate from said preselected map of acceptable values.

43. An apparatus as defined in claim 42 wberein said axis is vertical and said cooling assembly is axially below said heating coil.

44. A method of inductively heating and then quench hardening the surface of axially spaced cams on a steel camshaft having a longitudinally extending rotational axis concentric with a plurality of axially spaced bearings with surfaces concentric to said rotational axis, said cams having lobes with differing circumferential locations, said method comprising the steps of:

(a) providing an induction heating coil having an inner surface surrounding said work axis with an insulation gap and integral quenching openings for directing liquid inwardly from said heating coil toward said work axis;

(b) providing a high frequency power supply means for selectively energizing said heating coil with a power density within said heating coil of over about 20 $KW/in^2$;

(c) providing an auxiliary cooling assembly fixed with respect to said heating coil at an axially spaced position near said heating coil and including means for spraying a cooling liquid toward said work axis;

(d) causing relative axial movement of said camshaft and said heating coil to position a cam in said heating coil during a hardening cycle including an induction heating portion and quench hardening portion;

(e) rotating said camshaft about said work axis;

(f) selective rotating said camshaft to an indexed position with said cam in said coil having a preselected fixed circumferential orientation during at least said heating portion of said hardening cycle;

(g) selectively operating said power supply means during said heating portion of said cam hardening cycle;

(h) selectively operating said cooling assembly during said at least said heating portion of said hardening cycle for a cam in said heating coil;

(i) sequentially indexing further cams into said fixed orientation within said heating coil for hardening during a hardening cycle while a previously, axially adjacent, hardened cam is cooled in said cooling assembly; and, (j) detecting the hardened quality of said cams after said cams have been sequentially scanned by an eddy current coil concentric with said work.

45. A method as defined in claim 44 wherein said eddy current detecting step includes:

(k) progressively moving said eddy current coil along said camshaft;

(l) energizing said eddy current coil at least at each of said axially spaced cams;

(m) reading the eddy current responses of said energized eddy current coil at each of said hardened cams;

(n) comparing said eddy current response with a preselected map of acceptable responses;

(o) rejecting a camshaft when said eddy current responses deviate from said preselected map of acceptable responses.

46. A method of inductively heating and then quench hardening the surface of axially spaced cams on a steel camshaft having a longitudinally extending rotational axis concentric with a plurality of axially spaced bearings with surfaces concentric to said rotational axis said cams having lobes with differing circumferential locations said method comprising the following steps:

(a) providing an induction heating coil having an inner surface surrounding said work axis with an insulation gap and integral quenching openings for directing liquid inwardly from said heating coil toward said work axis;

(b) providing a high frequency power supply means for selectively energizing said heating coil with a power density within said heating coil of over about 20 $KW/in^2$;

(c) providing an auxiliary cooling assembly fixed with respect to said heating coil at an axially spaced position near said heating coil and including means for spraying a cooling liquid toward said work axis;

(d) causing relative axial movement of said camshaft and said heating coil to position a cam in said heating coil during a hardening cycle including an induction heating portion and quench hardening portion;

(e) rotating said camshaft about said work axis;

(f) means for selective rotating said indexed position with said cam in said coil having a preselected fixed circumferential orientation during at least said heating portion of said hardening cycle;

(g) selectively operating said power supply means during said heating portion of said cam hardening cycle;

(h) selectively operating said cooling assembly during said at least said heating portion of said hardening cycle for a cam in said heating coil;

(i) indexing a further cam into said fixed orientation within said heating coil for hardening during a hardening cycle while a previously, axially adjacent, hardened cam is cooled in said cooling assembly; and, controlling the sequencing of said method steps in accordance with the sensed position of the lobe on a selected one of said axially spaced cams.

47. A method as defined in claim 46 wherein said indexed position is with the lobe of a cam being heated by said heating coil is against said gap in said heating coil.

48. An apparatus for inductively heating and then quench hardening the surfaces of axially spaced cams on a steel canshaft having a longitudinal axis, said apparatus comprising: an induction heating coil with a central opening and means for directing a quenching liquid from said coil inwardly in said opening; a power supply having an output frequency of 10 KHz to about 25 KHz and an output power to create a power density of at least 20 $KW/in^2$ within said coil opening; means for moving said cam into said opening; means for energizing said coil with said power supply for a heating cycle of between 0.30 seconds and 1.5 seconds; means for actuating said quenching means immediately after said heating cycle for a quenching cycle; means for liquid cooling of portions of said camshaft adjacent said heating coil; and means for preventing said quenching liquid from flowing freely from said opening during said quenching cycle whereby said quenching liquid is directed toward substantially the full area of said surfaces.

49. An apparatus as defined in claim 48 wherein said camshaft is rotated during said heating cycle.

50. An apparatus as defined in claim 48 wherein said camshaft is stationary during said heating cycle and means for rotary indexing said cam being heated to a selected rotational position in said coil opening during said heating cycle.

51. An apparatus as defined in claim 48 wherein said means for preventing includes movable plate means for preventing cooling liquid from splashing said cam during said heating cycle.

52. An apparatus for inductively heating and then quench hardening the surfaces of axially spaced cams on a steel camshaft having a longitudinal axis, said apparatus comprising: an induction heating coil with a central opening and quenching means for directing a quenching liquid from said coil inwardly in said opening; a power supply having an output frequency of 10 KHz to about 25 KHz and an output power to create a power density of at least 20 $KW/in^2$ within said coil opening; means for moving said cam into said opening; means for energizing said coil with said power supply for a heating cycle of between 0.30 seconds and 1.5 seconds; means for actuating said quenching means immediately after said heating cycle for a quenching cycle; and means for liquid cooling of portions of said camshaft adjacent said heating coil; said quenching means including a plurality of openings in the range of 0.60–0.90 inches in diameter and means for forcing quenching liquid through said openings at a pressure of about 15–20 psi whereby a relatively low velocity stream of said liquid is directed from said coil.

53. An apparatus as defined in claim 52 wherein said camshaft is rotated during said heating cycle.

54. An apparatus as defined in claim 53 wherein said camshaft is stationary during said heating cycle and means for rotary indexing said cam belng heated to a selected rotational position in said coil opening during said heating cycle.

* * * * *